United States Patent [19]

Granger

[11] Patent Number: 4,846,035

[45] Date of Patent: Jul. 11, 1989

[54] PERFECTED CUTTING DEVICE FOR A DEVICE FOR DISPENSING AND SIMULTANEOUS CUTTING OF MATERIAL ROLLED UP IN WEBS

[76] Inventor: Maurice Granger, 17 Rue Marcel Pagnol, 42270 Saint Priest en Jarez, France

[21] Appl. No.: 136,339

[22] Filed: Dec. 22, 1987

[30] Foreign Application Priority Data

Dec. 30, 1986 [FR] France ..... 86 18497

[51] Int. Cl.[4] ..... B26D 1/56

[52] U.S. Cl. ..... 83/337; 83/342; 83/649

[58] Field of Search ..... 83/331, 332, 335, 336, 83/337, 338, 339, 340, 341, 342, 649

[56] References Cited

U.S. PATENT DOCUMENTS

| | | | |
|---|---|---|---|
| 2,278,029 | 3/1942 | Walsh et al. | 83/341 X |
| 3,739,965 | 7/1976 | Jespersen et al. | 83/337 |
| 4,122,738 | 10/1978 | Granger | 83/337 |
| 4,188,844 | 2/1980 | DeLuca | 83/337 |
| 4,404,880 | 9/1983 | DeLuca | 83/337 |
| 4,635,837 | 1/1987 | Granger | 83/337 X |

FOREIGN PATENT DOCUMENTS

| | | | |
|---|---|---|---|
| 695757 | 8/1953 | United Kingdom | 83/342 |

*Primary Examiner*—Donald R. Schran
*Assistant Examiner*—Y. C. Lin
*Attorney, Agent, or Firm*—Eric P. Schellin

[57] ABSTRACT

Improved cutting device for an apparatus for the simultaneous dispensing and cutting of bands of wound material. This device is distinguished in that it comprises two independent blades located side by side at an angle, each of which corresponds to two half-lengths of the drum, whereby each of the blades is fixed to blade carriers oriented angularly in the drum and is associated with a follower roller which cooperates respectively with a fixed cam of the same profile located on each lateral wing of the housing of the apparatus, whereby said cams are offset angularly in order to permit the progressive and successive exiting of each blade and to define two cutting zones of the band of material in the apparatus while obtaining only a single clean cutting line of said material perpendicular to its lateral edges.

6 Claims, 4 Drawing Sheets

Fig. 4
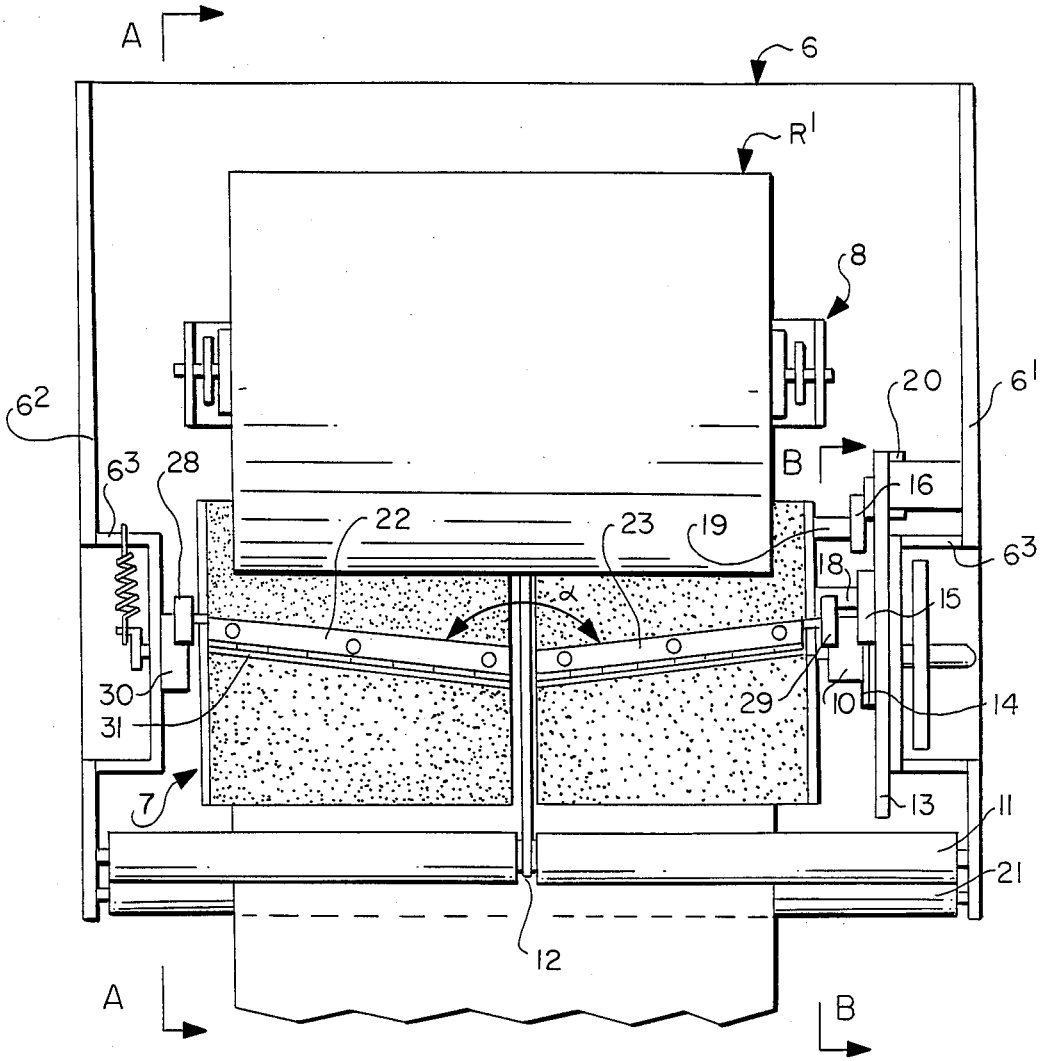
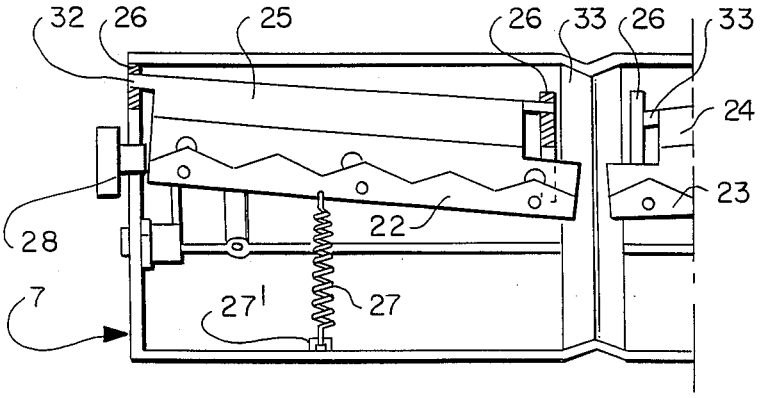
Fig. 7

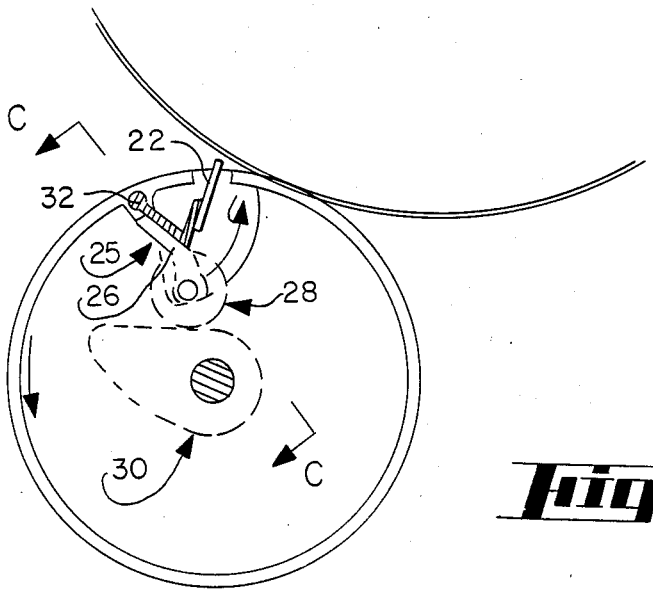
Fig. 9
Fig. 8
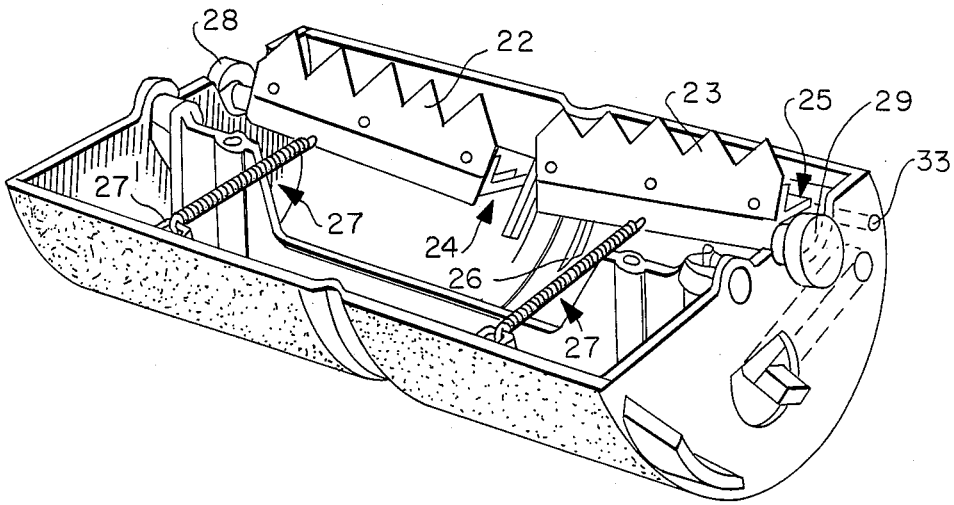

PERFECTED CUTTING DEVICE FOR A DEVICE FOR DISPENSING AND SIMULTANEOUS CUTTING OF MATERIAL ROLLED UP IN WEBS

BACKGROUND OF THE INVENTION

Perfected cutting device for a device for dispensing and simultaneous cutting of material rolled up in webs.

The object of the invention relates to the technical sector of means for dispensing lengths of material rolled up on reels. More particularly, but not exclusively, the invention relates to dispensers of paper, cotton wool and similar wiping materials.

FIELD OF THE INVENTION

The device is not limitative to the type according to which a roll of material in use is free rotating on a support and is applied with pressure directly on to a drum with a non-sliding surface so that by a simple manual pull on the web of material projecting from the device, a web is automatically dispensed and cut, the length of which is substanially equal to the drum diameter by means of a pinked cutting device associated with the drum and projecting outside the drum when it is rotated by pulling on the material, so as to penetrate into the material taut on either side of the cutting mechanism. After the cutting operation, the spinning drum goes back into its orginal position through the action of various additional components and a new web of material projects from the device.

Such a cutting device was particularly described in the French Pat. No. 2.332.215 and the certificate of addition No. 2.340.887 belonging to the applicant. The cutting device's driving means, the drum rotation and the moving control means, and stopping and control means were described in the previously mentioned patents and also in the European patent No. 0517713 and in the French Pat. Nos. 85.19447 and 85.02873 in the applicant's name. However, other means can be used. Nonetheless, it appeared important in order to fully understand the invention to be reminded beforehand, by way of a non-limitative example, the special features of the cutting device described in the previously mentioned patents, referring to FIGS. 1, 2 and 3 of drawings.

These diagramatically illustrate the movement of the cutting blade. The drum (1) of which the inside is hollow, is provided, allows for internal movement of the cutting blade (2) with respect to its rotation axis, through a roller (3) associated with the blade holder (4) cooperating with the contour of a fixed bearing (5) forming a cam around the latter. The bearing, by this cooperation, ensures a progressive dispensing movement of the blade (2), determined by the shape of the cam so as to have the same describing on the on the inside of the drum and simultaneously with the path of the latter and in the same direction, a 360° complete circle path from a retracted position up to a position near to the plane of tangency with respect to the paper web so that at the ending of the manual pull of the cutting blade across the drum slot, the blade projects in a crosswise direction in this web, with penetration in the paper web which is taut on both sides of the cutting blade.

The device of the type previously described is provided for the cutting off of lengths of material in webs of cotton wool and/or similar materials. This type of device is operated with a high rate of reliability and its commercial success confirms its technical performances.

However, on certain types of very thin wiping products the necessity appeared interesting to soften the pulling force of the cutting device during the paper cutting off operation. In fact, these very thin materials cause the paper to tear during the pulling operation with wet hands by the user.

The object according to the invention was therefore to improve the device's design in a non limitative manner in order to meet this requirement. Besides, the invention aims for a new cutting device whatever the additional means used for the drum stop control maybe.

After different tests and research carried out in relation to the rotation of the drum, a solution was found offering very performing unexpected results with regards to the cutting of very thin materials. This solution lies in a different arrangement of the cutting blade and cutting device in general according to an operating mode which is in opposition to the previous operation of this device as mentioned before, and of the prior art in general, the applicant has the knowledge of. This device is adaptable to single and double roll devices and generally to any device comprising a dispensing roll and at least a stand-by-roll.

SUMMARY OF THE INVENTION

According to a first feature, this devices comprises a hollow drum with a longitudinal slot on its external periphery, and taking a blade and blade holder hinged in opposition to a return means on the inside of the drum, the said blade projecting outside through the slot under the effect of rotation of the drum its during rotation whilst pulling on the material so as to penetrate into the material taut either side of the cutting device, the said blade being moved according to a path given through a follower roller joined with the blade holder and cooperating with mechanisms particularly including a fixed profiled cam arranged on a the side wall of the casing of the device arranged to take the said driving drum and one or several stand-by rolls, wherein the said device includes two independent blades arranged side by side according to an angle and each corresponding to half the length of the drum, the said blades fixed on blade holders, angularly oriented in the drum, are each associated toa follower roller respectively cooperating with a fixed cam of the same profile arranged on each side plate of the casing of the device, the said cams being angularly shifted to enable the progressive and successive projection of each blade and to define the two cutting zones of the web of material inside the device whereby obtaining only one clean cut of the said material perpendicular to its side edges.

Other specific objects and advantages will appear as the specification proceeds.

In order to clarify the object of the invention without limiting it, the invention is accompanied by the following drawings in which:

BRIEF DESCRIPTION OF THE INVENTION

FIGS. 1 and 2 are schematic views illustrating the functioning of the cutting device such as described in the patent Nos. 2.332.215 and 2.340.887 of the applicant.

FIG. 3 schematic illustrates the blade used to cut the paper web, according to FIGS. 1 and 2.

FIG. 4 is a front view of the device with the new cutting device in its non-limitative implementation with one of the devices in operation by the applicant.

FIG. 7 is a partial view illustrating the positioning of one of the cutting blades in the drum, in sections taken on the line C—C of the FIG. 9.

FIG. 8 is a sectional view illustrating the drum taken in a semi-assembly state and arranged with the two cutting blades according to the invention.

FIG. 9 is a schematic view illustrating the position of one of the cutting blades at the time of the cut of the paper web.

Figure 1:
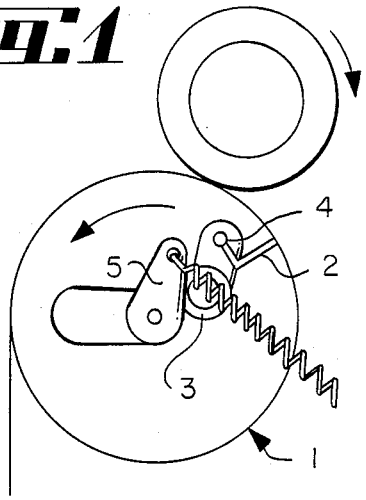
Figure 2:
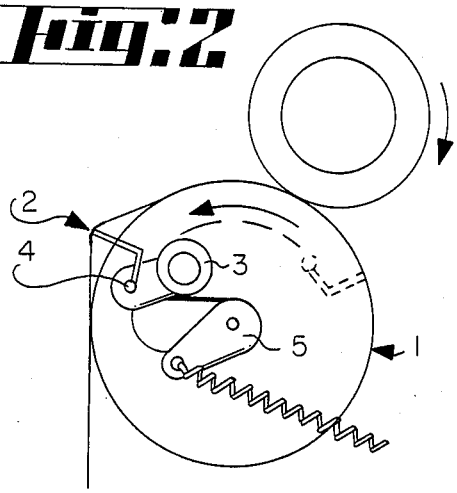
Figure 3:
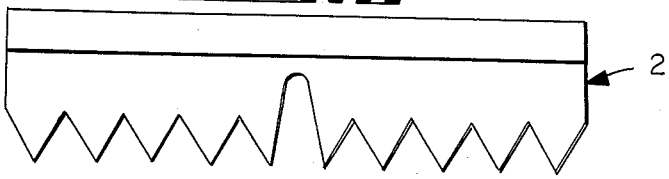

The object of the invention will become more apparent from the following non-limitative detailed description with the accompanying drawings.

The cutting device according to the invention can be used with any type of dispensing devices for material rolled up in webs, single roll, double roll and more generally, with a dispensing roll and several reserve rolls.

DETAILED DESCRIPTION OF THE INVENTION

The cutting device according to the invention applies naturally but in a non-limitative manner to the different devices the features of which were described and defined particularly in the afore-mentioned patents. It stands to reason that the cutting device according to the invention can, by its principle and function, be used with other devices.

A non-limitative application of the cutting device to GRANGER devices is illustrated, to emphasise the new inventive concept.

Beforehand, the main elements of the GRANGER device shall be briefly recalled. The device comprises from a casing, a wall fixing base plate (6), free rotating support means, a driving drum (7) with respect to side plates (6.1) (6.2) of the said casing. The inside of the drum is designed to take a blade holder hinged on the drum's side wall including a follower roller (28, 29) on the outside, cooperating with a fixed cam (10) to allow the periodic moving of the pinked cutting blade outside the drum, when the web of material projecting from the device is pulled, thereby rotating the drum with a rough surface on which the roll (R1) of rolled up material is applied. The latter is held by a support stirrup (8) hinged on the base plate. A roll (11) can also be seen according to a device described in another application, with a belt (12) also associated with the drum so as to properly guide the material towards the lower opening and to avoid the user putting his fingers inside, near the cutting blade.

Figure 6:
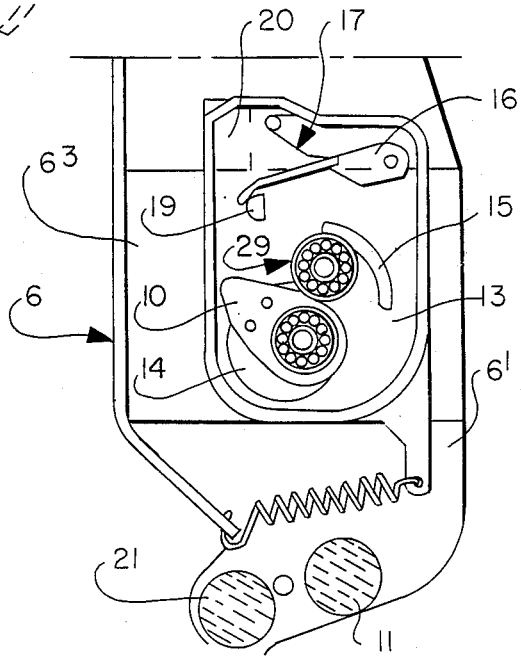
FIG. 6 is a side view taken on the line B—B of FIG. 4.

With reference to FIG. 4, the casing includes, at the same level as the drum positioning zone, the internal U-shaped clearances (6.3) on the side plates. The main means allowing the moving out of the blade, the means being arranged on one of the walls (6-1) of the casing shall be briefly recalled. With reference to FIGS. 4 and 6 as described in the previously-mentioned patents, the shock protector (13) is designed to successively take the plate support (14) of the cam (10), whilst the profiled cam (10) allows the guiding of the follower roller (28, 29) mounted on the blade holder, the ratchet pawl (16) with its return spring (17).

A fixed curvilinear ramp (15) of about 90 degrees is also illustrated, and on which the mobile stop (18) mounted on the drum is moved; the fixed stop arranged on the drum is referred to in (19). This ramp is arranged between the cam (10) and the ratchet pawl and its orientation is designed to allow the guiding and the support of the drum's mobile stop during its rotation. In (20) the non return stop of the shock protector is also illustrated and in (21) the guiding roll of the free end of the web of material. The mechanism's operation was described in the previously-mentioned prior patents which are to be referred to.

The cutting device integrated in the material driving includes, according to the invention, two independent blades (22–23) arranged side by side and each substantially corresponding to half the length of the drum. As per FIG. 4, the two blades are not placed in line but according to an angle $\alpha$ of about 150 to 179 degrees, preferably of about 170°. Thus the two blades are arranged substantially on a plane symmetric with respect to the transversal central line of the drum, and are thus mounted opposite. Their pinked sections however, are orientated on the same side. Each blade (22–23) is mounted on an L-shaped blade holder (24–25), hinged on its lower end on pins (32–33) positioned on support blocks (26) formed on the inside of the said drum; the support blocks of the same blade being shifted so as to give an angular orientation to the blades (FIGS. 7 and 4). Each blade holder (24–25) is arranged in the rest position corresponding to the withdrawal of the blade to the inside of the drum by a return spring (27) one end (27.1) of which is fixed to the drum wall. On the other hand, according to another embodiment of the invention, each blade or blade holder takes a roller (28–29) at its end, projecting from each side wall of the drum, the said roller being mounted in free rotation likely to act and cooperate with fixed cams arranged on the casing to take the drum and its additional mechanisms. So, it is apparent that each blade (22–23) has its own hinging movement whilst being similar to each other. In an advantageous manner, such a design is provided so that the drum's axis, the rotating axis of the rollers (28–29) and the hinge pin axis (32) situated towards the side of the drum of each blade holder are aligned substantially according to the line XX so as to limit the cutting forces. According to another particularly significant and complementary arrangement, the two afore-mentioned rollers (28–29) each cooperate with a fixed cam arranged on the device's casing. More precisely, by referring to figures of the drawings, a first fixed cam is that of (10) fixed on to the first side plate (6.1) of the casing of the side of the stopping and locking mechanism when the drum is in the position as illustrated in FIG. 6. A second fixed cam (30) is built up and fixed on the second side plate (6.2) of the casing opposite to the previous one. The two cams (10) and (30) have exactly the same peripheral profile so that when the follower rollers (28–29) associated to the blade holders (24–25) move around them along their external periphery, the paths of the two blades are exactly the same.

Nonetheless and according to an essential embodiment of the invention contributing to the proper operation of the cutting device in general, the two cams (10) and (30) have a different angular orientation of from around 80 to 100 degrees so that there is a continuity in the penetration of the two blades in to the web of material to be cut off. More specifically, as schematically shown in FIGS. 10 to 13, the angular shifting of the two cams (10–30) permits to obtain, firstly, the penetration into the wiping material by a blade (22) on a semi-width, then the other blade (23) on the second semi-width before the withdrawal of the first blade.

Figure 10:
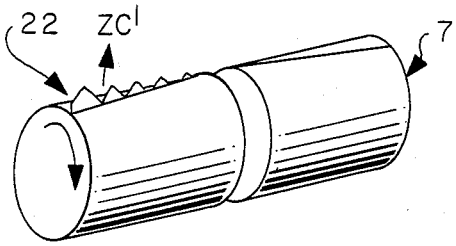
FIGS. 10, 11, 12 and 13 are schematic views illustrating the different advancing phases of the cut of a very thin material web, with the device according to the invention.
Figure 11:
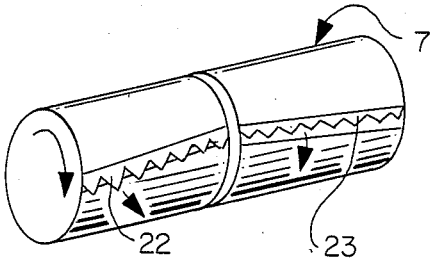
Figure 12:
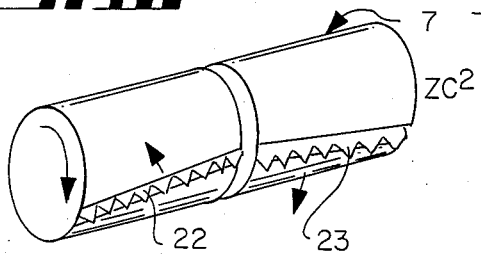
Figure 13:
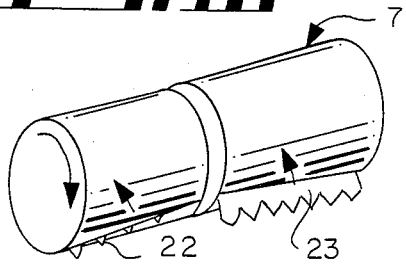
Figure 5:
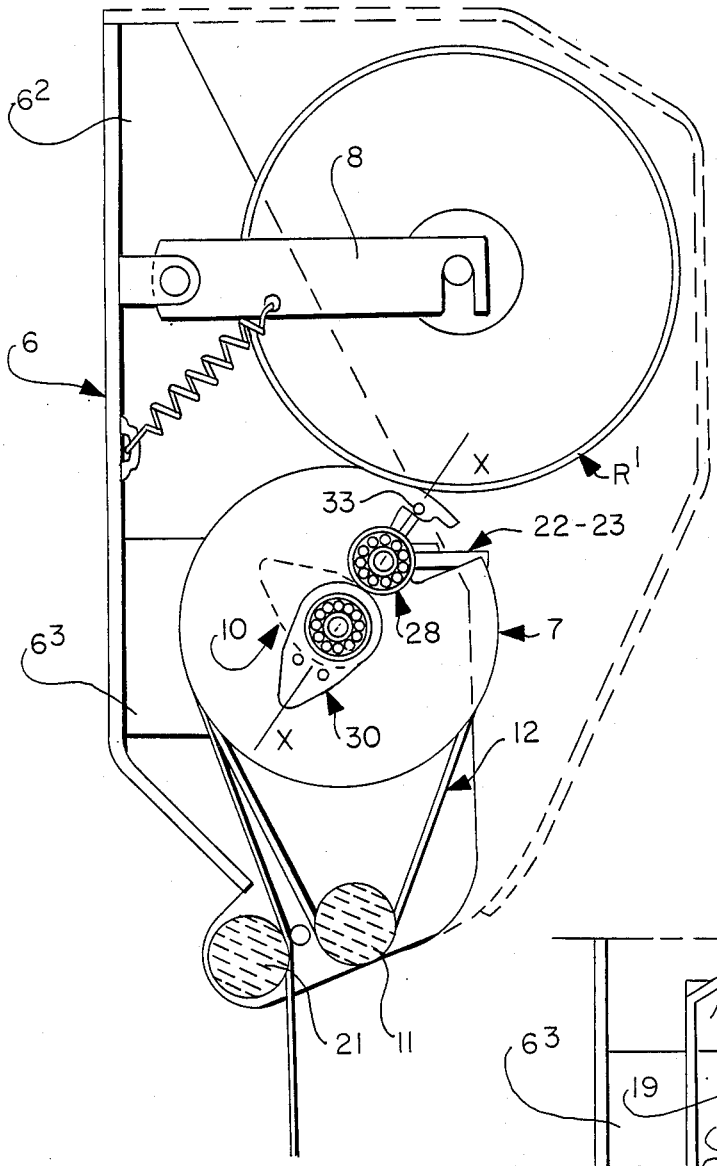
FIG. 5 is a side view taken on the line A—A of FIG. 4.

According to another interesting embodiment, the projection of teeth of each blade is progressive, in the sense that, as the drum rotates with the successive projection of blades, the teeth situated on the outside of the drum come out first, then the others move to the central part of the material. So, the depth of projection of the different teeth of each blade varies substantially, the projection being maximum for the tooth the nearest to the side end of the drum. On the other hand, the slot (31) formed on the drum through which the blades pass, is cut according to a V-shaped profile complementary to the profile and arrangements of blades. Therefore, there are two different cutting zones of the web of paper with respect to its dispensing roll and driving drum, one is situated substantially after the plane of contact of the roll of paper and the driving drum (ZCI, cutting zone 1) as illustrated in FIG. 10 and the other in the lower rear part of the driving drum illustrated by the reference (ZC2, cutting zone 2).

The cut is made along a continuous horizontal line of the web of material. On the other hand, according to FIGS. 10 to 13 it is schematically shown that the last tooth of the first blade situated the nearest to the centre of the drum starts a V-shaped cutting off operation corresponding to the profile of the tooth and the last tooth of the second blade situated nearest to the centre of the drum starts another V-shaped cutting off operation adjacent to the afore-mentioned, a minute web of paper ensuring the connection between them. Under the continuous pulling effect by the user on the web of material, the said connecting web is also torn finally separating the piece of paper pulled. The cutting of the material according to the previously-mentioned device is carried out by tearing the paper web with a progressive action. The fact that the sloping of the cutting blades in two planes, on the one hand, with respect to the longitudinal axis of the drum or its external generating line and on the other hand, the sloping of the teeth of each blade, into depth whilst moving towards the central part of the drum, combined with the cam profiles, allows a straight and clean cutting operation on the paper with no jagged edges perpendicularly to the sides of the web of paper, must be emphasised.

The result obtained, i.e. the quality of the cut and its cleanless requires particularly precise positioning of the different components of the cutting device. The fact that the first blade (22) penetrates into the material by a hinging movement given according to the arrow F1, contrary to the unrolling direction, F2 of the drum which enhances the tearing effect with less force must be highlighted. The second blade (23) penetrates in the same direction as the unrolling direction of the drum.

It is also necessary to point out that the sloping of the wide V-shaped opening for passage of blades outside the drum, avoiding the premature stopping of the roll of material at this stage, as the roll of material always has a point contact or a contact with a generating line with the driving drum. Comparatively to the prior art, the passage on a flat surface through the rectilinear slot of the drum on which the paper roll can be supported is no longer a hindrance.

Thus, according to the invention, the cutting of a paper web is carried out according to an original procedure. The cut is made in two stages, in two different cutting zones in situ in the device and thanks to special postioning of cutting blades and their respective teeth, the cutting line on the paper web is rectilinear and perpendicular to its edges.

Thanks to these different arrangments, the force of different return springs can be reduced and therefore their cost. Very thin wiping materials can be pulled with wet hands without the risk of unforeseen tearing.

I claim:

1. A dispensing and simultaneous cutting device for perfected cutting of material rolled up in webs comprising, a hollow drum (7) with a longitudinal slot on its external periphery, a cutting blade and blade holder hinged in opposition to return means inside the drum, said blade projecting externally through a slot under the effect of rotating said drum by pulling on the material to penetrate into the material taut on both sides of the cutting device, said blade being moved according to a path given by a follower roller associated with the blade holder and cooperating with a fixed profiled cam arranged on the side plate of the casing of the device to receive said driving drum (7) and one or several standby rolls (R1); said cutting device comprises two independent blades (22–23) arranged side by side at an angle and wherein each blade corresponds to half a length of the drum, said blades being fixed on the blade holders (24–25) angularly orientated in the drum, and wherein the drum is associated with a follower roller (28–29) which cooperates with a fixed cam (10–30) of the same profile arranged on each side plate of a casing of the device, said cams (10–30) being angularly adjustable to allow the progressive and successive projection of each blade and to define the two cutting zones (ZC1, ZC2) of the material web inside the device to obtain only one clean cut of the said material perpendicular to its side edges.

2. Cutting device as claimed in claim 1 wherein, each blade (22–23) is mounted onto an L-shaped blade holder (24–25), hinged by its bottom end on pins (32–33) positioned on support blocks (26) shifted for the assembly of each blade, and formed on the inside of the said drum.

3. Cutting device as claimed in claims 1 or 2 wherein, the drum axis, the rotation axis of follower rollers (28–29) and the hinge pin axis (32) of each blade holder, situated at the side of drum, are aligned.

4. Cutting device as claimed in claim 1 wherein, the two cams (10–30) are angularly shifted according to an orientation of about 80 to 100 degrees, allowing, when the drum is rotated, the penetration into the wiping material of a first blade (22) on a semi-width, then the other blade (23) on the second semi-width before the withdrawal of the first blade.

5. Device as claimed in claim 4 wherein, the projection of the teeth of each blade (22–23) is progressive, the teeth, situated on the outside of the drum project first, then the other move progressively to the central part of the material.

6. Device as claimed in claim 1 wherein, the slot (31) formed on the drum has a V-shaped profile complementary to the profile and arrangements of blades.

* * * * *